US008662612B2

(12) United States Patent
Sasaki

(10) Patent No.: US 8,662,612 B2
(45) Date of Patent: Mar. 4, 2014

(54) IMAGE FORMING APPARATUS INCLUDING RECORDING HEAD FOR EJECTING LIQUID DROPLETS

(75) Inventor: Shino Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/603,211

(22) Filed: Sep. 4, 2012

(65) Prior Publication Data

US 2013/0063507 A1 Mar. 14, 2013

(30) Foreign Application Priority Data

Sep. 12, 2011 (JP) ..... 2011-198220

(51) Int. Cl.
*B41J 29/38* (2006.01)

(52) U.S. Cl.
USPC ..... 347/11; 347/10

(58) Field of Classification Search
USPC ..... 347/9–11
See application file for complete search history.

(56) References Cited

U.S. PATENT DOCUMENTS

| | | | | |
|---|---|---|---|---|
| 7,628,463 | B2 * | 12/2009 | Sasaki | 347/11 |
| 2008/0123117 | A1 | 5/2008 | Kimura et al. | |
| 2008/0150983 | A1 | 6/2008 | Sasaki | |

FOREIGN PATENT DOCUMENTS

| | | |
|---|---|---|
| JP | 2002-273912 | 9/2002 |
| JP | 2008-213471 | 9/2008 |
| JP | 2010-94871 | 4/2010 |
| JP | 2010-179531 | 8/2010 |

OTHER PUBLICATIONS

U.S. Appl. No. 13/544,149, filed Jul. 9, 2012, Kazuki Yasu, et al.

* cited by examiner

*Primary Examiner* — Juanita D Jackson
(74) *Attorney, Agent, or Firm* — Cooper & Dunham LLP

(57) ABSTRACT

An image forming apparatus includes a recording head, a head driving control unit, and a dummy ejection control unit. The dummy ejection control unit controls first dummy ejection operation to eject droplets to a continuous medium per a constant length and second dummy ejection operation to eject droplets not contributing to image formation to an image formation area. In the first dummy ejection operation, the head driving control unit applies a first non ejection pulse to a pressure generator corresponding to a non ejection nozzle. In the second dummy ejection operation, the head driving control unit applies a second non ejection pulse to the pressure generator corresponding to the non ejection nozzle. When the second non ejection pulse is applied, an amplitude or number of vibrations of a meniscus of liquid in the non ejection nozzle is greater than when the first non ejection pulse is applied.

4 Claims, 11 Drawing Sheets

| | T1 | T2 | T3 | T4 | T5 | T6 | T7 |
|---|---|---|---|---|---|---|---|
| LARGE DROPLET | ○ | ○ | ○ | ○ | ○ | ○ | ○ |
| MEDIUM DROPLET | – | – | – | ○ | – | ○ | ○ |
| SMALL DROPLET | – | ○ | – | – | – | – | – |
| FIRST MICRO VIBRATING | ○ | – | – | – | – | – | – |
| SECOND MICRO VIBRATING | – | – | – | – | – | ○ | – |

| | T1 | T2 | T3 | T4 | T5 | T6 | T7 | T8 | T9 |
|---|---|---|---|---|---|---|---|---|---|
| LARGE DROPLET | ○ | ○ | ○ | ○ | ○ | ○ | ○ | ○ | ○ |
| MEDIUM DROPLET | – | – | – | – | ○ | – | ○ | ○ | ○ |
| SMALL DROPLET | – | – | ○ | – | – | – | – | – | – |
| FIRST MICRO VIBRATING | – | – | – | ○ | – | – | – | – | – |
| SECOND MICRO VIBRATING | ○ | – | – | – | – | – | – | ○ | – |

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-198220, filed on Sep. 12, 2011, in the Japan Patent Office, the entire disclosure of which is hereby incorporated by reference herein.

BACKGROUND

1. Technical Field

This disclosure relates to all image forming apparatus, and more specifically to an image forming apparatus including a recording head for ejecting liquid droplets.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, for example, an inkjet recording apparatus is known that uses a recording head (liquid-droplet ejection head) for ejecting liquid droplets.

In such a liquid-ejection-type image forming apparatus, when liquid is not ejected from nozzles of the recording head for a long time, micro vibrating pulses (non-ejection pulses) may be applied to the head to vibrate the meniscus of liquid in the nozzles without ejecting liquid droplets from the recording head to maintain the condition of the nozzles.

For the micro vibrating of the recording head, for example, JP-2010-179531 proposes to apply different types of micro vibrating waveforms in response to the ejection rate of liquid.

To maintain the condition of the nozzles of the recording head, such an image forming apparatus may also perform, during printing, dummy ejection operation (also referred to as flushing operation) in which liquid droplets not contributing to image formation (dummy ejection droplets) are ejected from the nozzles of the recording head.

In addition, such an image forming apparatus may be a line-type image forming apparatus capable of printing images on a continuous recording medium, such as a rolled sheet of paper, a continuous sheet of paper, a continuous-form paper, or a web medium. In such a case, unlike a case where cut sheets are used as recording media, dummy ejection operation cannot be performed between recording media conveyed. Hence, the image forming apparatus performs one of first-type dummy ejection operation (referred to as line flushing operation) to perform dummy ejection per a certain length of the continuous recording medium or second-type dummy ejection operation (referred to as star flushing operation) to eject a less visible size of liquid droplets for dummy ejection on an image formation area of the recording medium. For example, JP-2008-213471 proposes such a line flushing operation.

For the line flushing operation of the line-type image forming apparatus using the continuous sheet, it is necessary to cut portions of the continuous sheet on which liquid droplets for dummy ejection are ejected. Therefore, it is disadvantageous in that a portion of recording media (cut portion) is wasted. However, it is advantageous in that liquid droplets for dummy ejection can be intensively discarded.

By contrast, for the star flushing operation, it is advantageous in that such a wasted portion of recording medium does not occur. However, since a less visible size of small droplets are discarded over an image formation area of a recording medium, the effect of discarding liquid droplets may not be sufficiently obtained in a less-humid condition or an image of a low printing duty.

In the dummy ejection operation, by discarding viscosity-increased liquid not used for image formation from nozzles, the nozzles are maintained in a state in which liquid droplets can be normally ejected from the nozzles, thus requiring waste of liquid ejected for dummy ejection. Therefore, it is preferable to minimize the waste of liquid and increase cost per performance (CPP).

BRIEF SUMMARY

In an aspect of this disclosure, there is provided an image forming apparatus including a recording head, a head driving control unit, and a dummy ejection control unit. The recording head includes a plurality of nozzles, a plurality of individual liquid chambers, and a plurality of pressure generators. The plurality of nozzles ejects liquid droplets. The plurality of individual liquid chambers is communicated with the plurality of nozzles. The plurality of pressure generators generates pressure to pressurize liquid in the plurality of individual liquid chambers. The head driving control unit applies an ejection pulse to a pressure generator of the plurality of pressure generators corresponding to an ejection nozzle of the plurality of nozzles to eject liquid droplets from the recording head and a non ejection pulse to a pressure generator of the plurality of pressure generators corresponding to a non ejection nozzle of the plurality of nozzles to vibrate a meniscus of liquid in the non ejection nozzle without ejecting liquid droplets. The dummy ejection control unit controls dummy ejection operation to eject liquid droplets not contributing to image formation from the recording head. The dummy ejection control unit is capable of controlling, as the dummy ejection operation, first dummy ejection operation to eject the liquid droplets not contributing to image formation to a continuous recording medium per a constant length of the continuous recording medium and second dummy ejection operation to eject the liquid droplets not contributing to image formation to an image formation area of the continuous recording medium. When the dummy ejection control unit controls the first dummy ejection operation, the head driving control unit applies a first non ejection pulse as the non ejection pulse to the pressure generator corresponding to the non ejection nozzle. When the dummy ejection control unit controls the second dummy ejection operation, the head driving control unit applies a second non ejection pulse as the non ejection pulse to the pressure generator corresponding to the non ejection nozzle. When the second non ejection pulse is applied to the pressure generator corresponding to the non ejection nozzle, an amplitude or number of vibrations of the meniscus of liquid in the non ejection nozzle is greater than when the first non ejection pulse is applied to the pressure generator corresponding to the non ejection nozzle.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
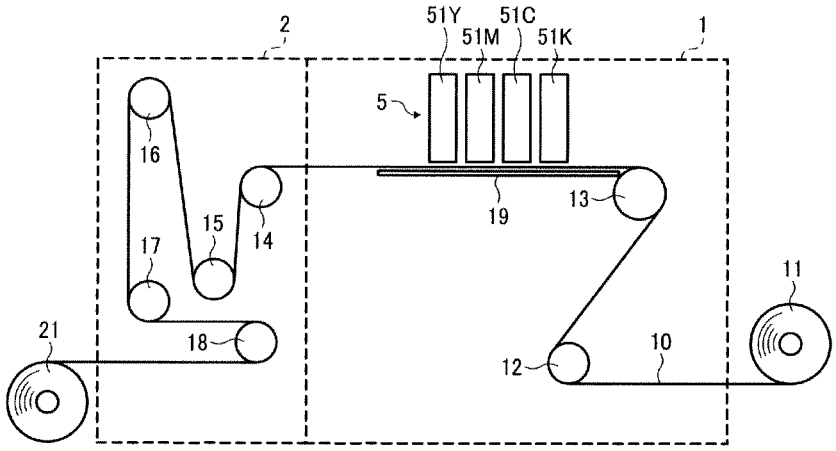
FIG. 1 is a schematic view of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIG. 1.

FIG. 1 is a schematic view of the image forming apparatus.

The image forming apparatus of FIG. 1 is a full-line-type inkjet recording apparatus. In the image forming apparatus, an apparatus body 1 and an exit unit 2 to secure a drying time are arranged side by side.

In the image forming apparatus, a recording medium 10 is rotationally fed from a media roller 11, fed by feed rollers 12 to 18, and reeled by a reel roller 21.

The recording medium 10 is fed on a platen 19 between the feed roller 13 and the feed roller 14 while opposing an image forming section 5, and the image forming section 5 ejects liquid droplets to form an image on the recording medium 10.

The image forming section 5 includes full-line-type recording heads 51K, 51C, 51M, 51Y (hereinafter, "recording heads 51 unless colors thereof distinguished) to eject droplets of ink of black (K), cyan (C), magenta (M), and yellow (Y) onto the recording medium 10 fed from an upstream side in a direction in which the recording medium 10 is fed, i.e., a media feed direction indicated by an arrow D in FIGS. 2 and 3. It is to be noted that the number and types of color is not limited to the above-described four colors of K, C, M, and Y and may be any other suitable number and types.

Figure 2:
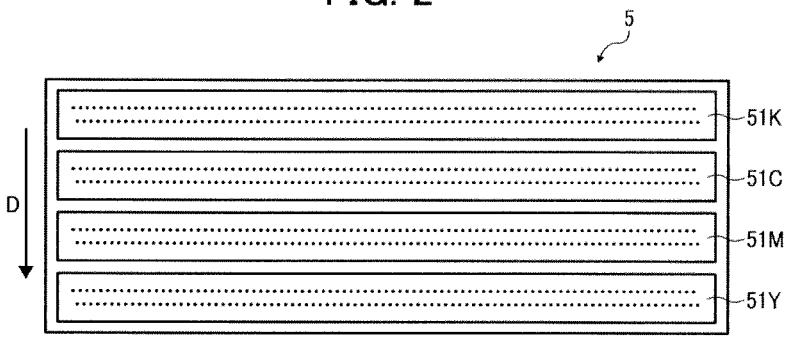
FIG. 2 is a plan view of an example of recording heads of the image forming apparatus.

For example, as illustrated in FIG. 2, each of the recording heads 51 may be a full-line-type recording head. Alternatively, as illustrated in FIG. 3, in each of the recording heads 51, short heads 100 may be arrayed as a head array in zigzag manner on a base member 52 to form a full-line-type recording head having a width corresponding to a width of recording media. In this exemplary embodiment, the recording head 51 is formed of a liquid ejection head unit including a liquid ejection head and a head tank to supply liquid to the liquid ejection head. However, it is to be noted that the configuration of the recording head is not limited to the liquid ejection head unit and may be formed of, e.g., only the liquid ejection head.

Next, an example of the liquid ejection head forming the recording head is described with reference to FIGS. 4 and 5.

Figure 3:
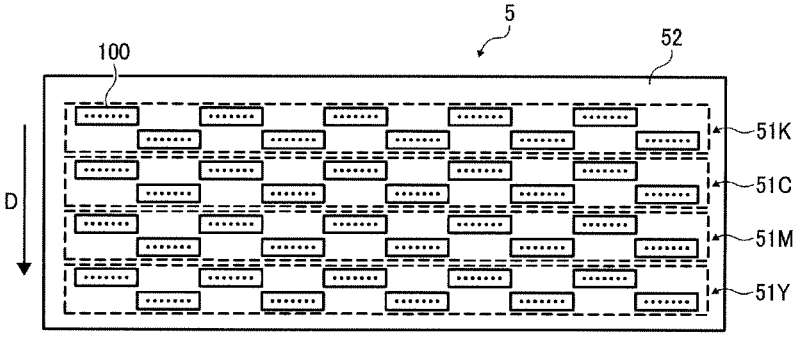
FIG. 3 is a plan view of another example of recording heads of the image forming apparatus.
Figure 4:
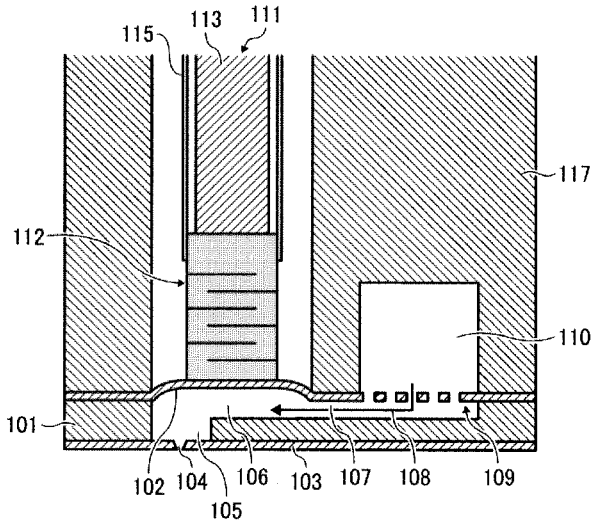
FIG. 4 is a cross-sectional view of a liquid ejection head forming a recording head of the image forming apparatus cut along a longitudinal direction of a liquid chamber.
Figure 5:
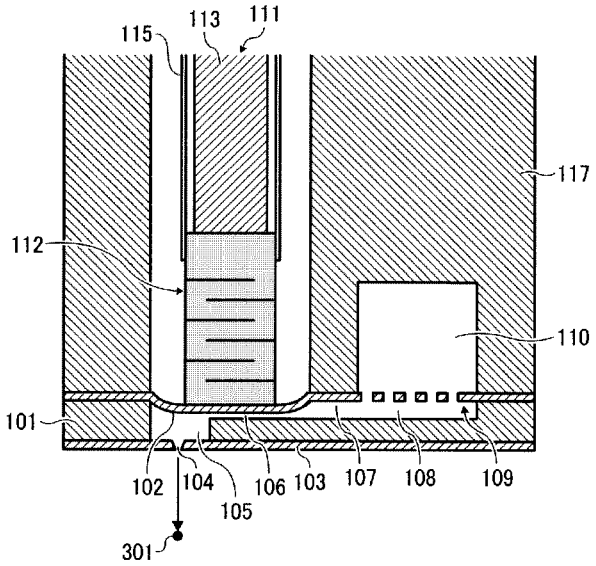
FIG. 5 is a cross-sectional view of the liquid ejection head in droplet ejection operation.

FIGS. 4 and 5 are cross-sectional views of the liquid ejection head cut along a longitudinal direction of a liquid chamber of the liquid ejection head (a direction perpendicular to a nozzle array direction). Here, the liquid ejection head having the configuration of FIG. 3 is described with reference to FIGS. 4 and 5.

In the liquid ejection head, a channel plate 101, a diaphragm member 102, and a nozzle plate 103 are bonded together to form individual liquid chambers 106, fluid resistance portions 107, and liquid introducing portions 108. The individual liquid chambers 106 are also referred to as, e.g., pressurization chambers, pressurized liquid chambers, pressure chambers, individual channels, and pressure generating chambers, and hereinafter simply referred to as "liquid chambers". As illustrated in FIGS. 4 and 5, a liquid chamber 106 communicates via a through hole 105 with a nozzle 104 from which liquid is ejected. A fluid resistance portion 107 and a liquid introducing portion 108 supply liquid to the liquid chamber 106. A common chamber 110 is formed in a frame member 117, and a filter 109 is formed in the diaphragm member 102. The liquid (ink) is introduced from the common chamber 110 to the liquid introducing portion 108 via the filter 109, and supplied from the liquid introducing portion 108 to the liquid chamber 106 via the fluid resistance portion 107.

The channel plate 101 is formed by laminating metal plates made of, e.g., stainless used steel (SUS) so as to have openings and channels, such as the through holes 105, the liquid chambers 106, the fluid resistance portions 107, and the liquid introducing portions 108. The diaphragm member 102 is a wall member forming a wall face of each of the liquid chambers 106, the fluid resistance portions 107, and the liquid introducing portions 108. In addition, as described above, the filters 109 are formed in the diaphragm member 102. It is to be noted that, instead of laminating metal plates of, e.g., SUS, the channel plate 101 may be formed by, for example, anisotropically etching a silicon substrate.

In FIG. 3, a laminated piezoelectric member 112 is bonded to a face of the diaphragm member 102 opposite a face facing the liquid chamber 106. The laminated piezoelectric member 112 is a pillar-shaped electromechanical transducer serving as a driving element (actuator device, pressure generator) to generate energy for applying pressure to ink in the liquid chamber 106 to eject liquid droplets from the nozzle 104. One end of the piezoelectric member 112 is bonded to the base member 113, and flexible printed cables (FPCs) 115 are connected to the piezoelectric member 112 to transmit driving waveform. Thus, a piezoelectric actuator 111 is formed.

In this exemplary embodiment, the piezoelectric member 112 is used in, for example, a d33 mode to expand and contract in a direction (laminated direction) in which the metal plates are laminated. Alternatively, the piezoelectric member 112 may be used in, for example, a d31 mode to expand and contract in a direction perpendicular to the laminated direction.

In the liquid ejection head having the above-described configuration, for example, as illustrated in FIG. 4, by reducing the voltage applied to the piezoelectric member 113 below a reference potential Ve, the piezoelectric member 112 contracts to deform the diaphragm member 102. As a result, the volume of the liquid chamber 106 expands, thus causing ink to flow into the liquid chamber 106. Then, as illustrated in FIG. 5, by increasing the voltage applied to the piezoelectric member 112 above the reference potential Ve, the piezoelectric member 112 extends in the laminated direction to deform the diaphragm member 102 toward the nozzle 104, thus contracting the volume of the liquid chamber 106. As a result, ink in the liquid chamber 106 is pressurized, thus ejecting a liquid droplet 301 from the nozzle 104.

Then, by returning the voltage applied to the piezoelectric member 112 to the reference potential Ve, the diaphragm member 102 returns to its original position (restores its original shape). As a result, the liquid chamber 106 expands and a negative pressure occurs in the liquid chamber 106, thus replenishing ink from the common chamber 110 to the liquid chamber 106. After vibration of a meniscus surface of the nozzle 104 decays to a stable state, the process shifts to an operation for the next droplet ejection.

Next, a controller of the image forming apparatus is described with reference to FIG. 6.

Figure 6:
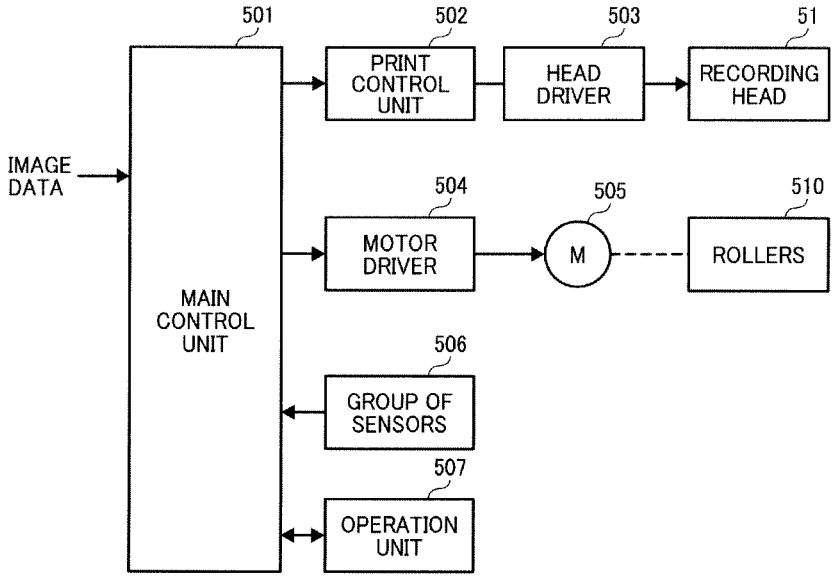
FIG. 6 is a block diagram of a controller of the image forming apparatus.

FIG. 6 is a block diagram of a controller 500 of the image forming apparatus.

The controller 500 has a main control unit (system controller) 501 including, e.g., a micro computer, an image memory, and a communication interface. The main control unit 501 generally controls the entire image forming apparatus and also serves as a head driving control unit and a dummy ejection control unit. The main control unit 501 transmits print data to a print control unit 502 to form an image on a sheet of recording media in accordance with image data and command information transferred from, e.g., an external information processing device (host).

The print control unit 502 transfers, as serial data, the image data received from the main control unit 501 and outputs, to a head driver 503, for example, transfer clock signals, latch signals, and control signals required for the transfer of image data and determination of the transfer. In addition, the print control unit 502 has a driving signal generator (701 in FIG. 7) including, e.g., a digital/analog (D/A) converter, a voltage amplifier, and a current amplifier, and outputs a driving signal containing one or more driving pulses to the head driver 503. The D/A converter converts pattern data of driving pulses stored on, e.g., a read only memory (ROM) from digital data to analog data.

In accordance with serially-inputted image data corresponding to one line recorded by the recording head 51, the head driver 503 serving as a selective applicator selects driving pulses of a driving waveform transmitted from the print control unit 502 and applies the selected driving pulses to the piezoelectric member 112 to drive the recording head 51. Thus, the piezoelectric member 112 serving as the pressure generator generates energy to eject liquid droplets from the recording head 51. At this time, by selecting a part or all of the driving pulses forming the driving waveform or a part or all of waveform elements forming a driving pulse, the recording head 51 can selectively eject dots of different sizes, e.g., large droplets, medium droplets, and small droplets.

The main control unit 501 controls driving of a group of rollers 510 including, e.g., the media roller 11, the feed rollers 12 to 18, and the reel roller 21 via a motor driver 504.

Detection signals from a group of sensors 506 including various types of sensors are input to the main control unit 501. The main control unit 501 inputs and outputs various types of information and transmits and receives display information between an operation unit 507 and it.

Figure 7:
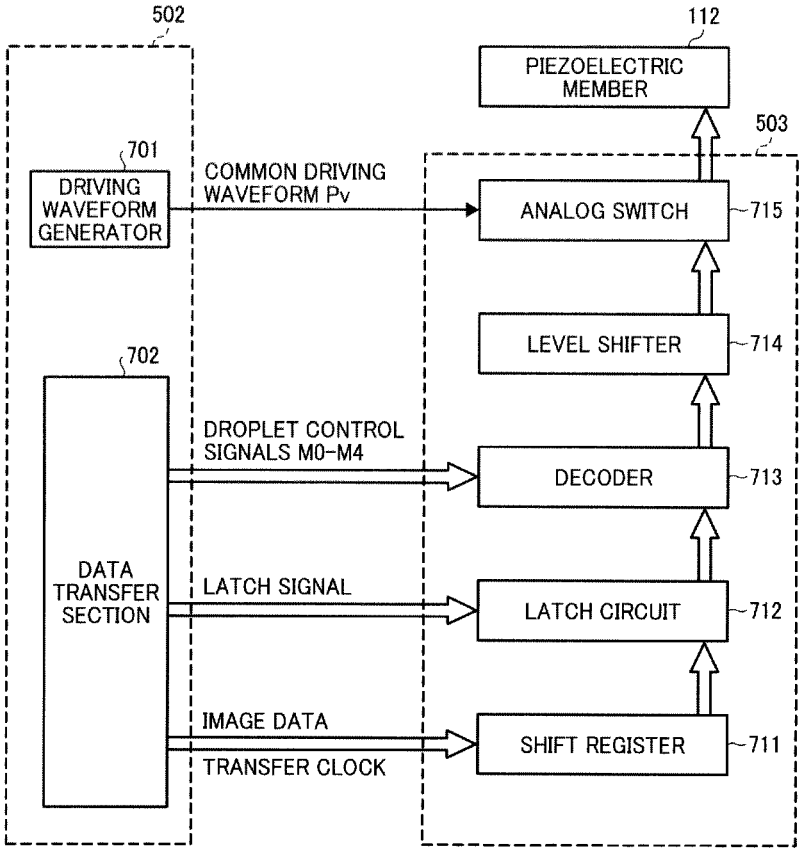
FIG. 7 is a block diagram of a print control unit of the controller and a head driver.

Next, an example of the print control unit 502 and the head driver 503 is described with reference to FIG. 7.

The print control unit 502 includes the driving waveform generator 701 and a data transfer section 702. The driving waveform generator 702 generates and outputs a driving waveform (common driving waveform) containing a plurality of pulses (driving signals) within a single print cycle (driving cycle) in image formation. The data transfer section 702 outputs clock signals, latch signals (LAT), droplet control signals M0 to M4, and two-bit image data (gray-scale signals 0 and 1) corresponding to print image.

The droplet control signals are two-bit signals for instructing the opening and closing of an analog switch 715 serving as a switching device of the head driver 503 in connection with each droplet. In synchronization with the print cycle of the common driving waveform, the droplet control signals change the state to a high (H) level (ON state) at a selected puke or waveform element and to a low (L) level (OFF state) at a non-selected pulse or waveform element.

The head driver 503 includes a shift register 711, a latch circuit 712, a decoder 713, a level shifter 714, and the analog switch 715. The shift register 711 receives transfer clocks (shift clocks) and serial image data (gray-scale data: two bits/one channel, i.e., one nozzle) from the data transfer section 702. The latch circuit 712 latches values of the shift register 711 based on latch signals. The decoder 713 decodes gray-scale data and control signals M0 to M4 and outputs decoded results. The level shifter 714 shifts the level of logic-level voltage signals of the decoder 713 to a level at which the analog switch 715 is operable. The analog switch 715 is turned on/off (opened and closed) in response to the outputs of the decoder 713 transmitted via the level shifter 714.

The analog switch 715 is connected to a selection electrode (individual electrode) of each piezoelectric member 112 and receives a common driving waveform Pv from the driving waveform generator 701. When the analog switch 715 is turned on in response to a result obtained by decoding the serially-transferred image data (gray-scale data) and the droplet control signals M0 to M4 with the decoder 713, a desired pulse (or waveform element) of the common driving waveform Pv passes (is selected by) the analog switch 715 and is applied to the piezoelectric member 112.

Next, an example of the relation between dummy ejection operation and micro vibrating waveform (non-ejection pulse) is described below.

Since the image forming apparatus uses a continuous sheet as the recording medium, dummy ejection is performed during printing. Hence, as described above, the dummy ejection control unit (formed by, e.g., programs) controls dummy ejection operation of the main control unit 501. As dummy ejection operation to eject droplets (dummy ejection droplets) not contributing image formation from the recording heads 51, the dummy ejection control unit controls, for example, first dummy ejection operation (line flushing operation) to eject droplets for dummy ejection once per a certain length of a continuous recording medium and second dummy ejection (star flushing operation) to eject a less-visible size of fine droplets for dummy ejection on an image formation area of a continuous recording medium.

Figure 8A:
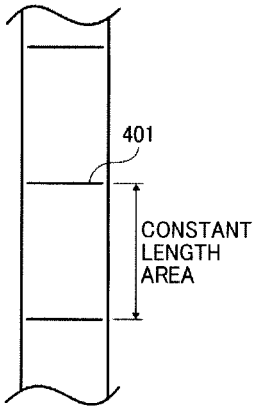
FIG. 8A is a schematic view of an example of line flushing operation (first dummy ejection)

FIG. 8A shows an example of the line flushing operation (first dummy ejection). The first dummy ejection is referred to as line flushing since relatively large dummy ejection droplets 401 are landed on a recording medium so as to form a line.

Figure 8B:
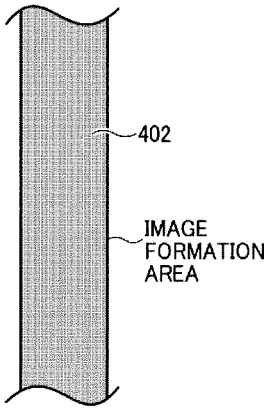
FIG. 8B is a schematic view of an example of star flushing operation (second dummy ejection)

FIG. 8B shows an example of the star flushing operation (second dummy ejection). The second dummy ejection is referred to as star flushing since relatively small dummy ejection droplets 402 are scattered like stars on an image formation area of a continuous recording medium.

During printing, ejection pulses for ejecting liquid droplets are applied to pressure generators of ejection nozzles of the recording heads 51 from which liquid droplets are to be ejected, and non-ejection pulses (micro vibrating pulses) for vibrating menisci of nozzles of the recording heads 51 without ejecting liquid droplets are applied to pressure generators of non-ejection nozzles of the recording heads 51 from which liquid droplets are not to be ejected.

Figure 9:
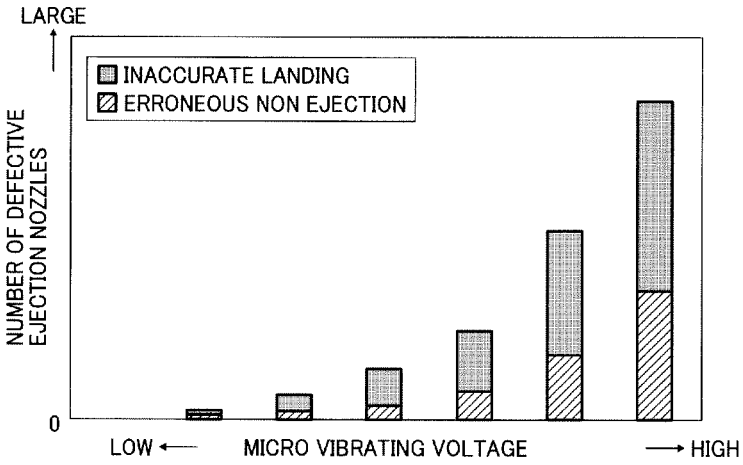
FIG. 9 is a chart of a relation between the voltage value (peak value) of micro vibrating pulse and the recovery state of nozzles in line flushing operation (first dummy ejection)
Figure 10:
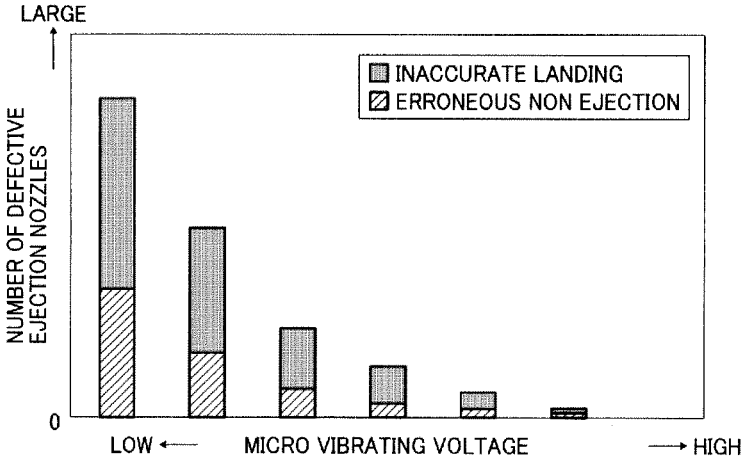
FIG. 10 is a chart of a relation between the voltage value (peak value) of micro vibrating pulse and the recovery state of nozzles in star flushing operation (second dummy ejection)

Here, an example of the relation between the voltage value (peak value) of micro vibrating pulse and the recovery state of nozzles is shown in FIGS. 9 and 10.

For dummy ejection performed by line flushing operation (first dummy ejection), as illustrated in FIG. 9, as the voltage value of micro vibrating waveform increases, the number of defective ejection nozzles causing erroneous non ejection or inaccurate landing position also increases. In other words, for the dummy ejection performed by line flushing operation (first dummy ejection), as the voltage value of micro vibrating pulse decreases, the nozzle recovery effect (dummy ejection effect) can be obtained even at a smaller number of droplets.

By contrast, for dummy ejection performed by star flushing operation (second dummy ejection), as illustrated in FIG. 10, as the voltage value of micro vibrating waveform decreases, the number of defective ejection nozzles causing erroneous non ejection or inaccurate landing position increases. In other words, for the dummy ejection performed by star flushing operation (second dummy ejection), as the voltage value of micro vibrating pulse increases, the nozzle recovery effect (dummy ejection effect) can be obtained even at a smaller number of droplets.

The relation is further described below with reference to FIGS. 11A 11B, 12A, and 12B.

Figure 11A:
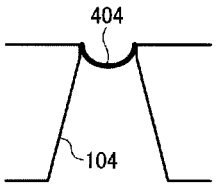
FIG. 11A is a schematic view of a state of a nozzle part during line flushing operation.

First, FIG. 11A shows a state of a nozzle 104 after line flushing operation is performed at a low voltage of micro vibrating pulse. In this case, the low voltage of micro vibrating pulse causes small vibration of the meniscus of ink in the nozzle 104. As a result, the viscosity of ink increases only at a portion (viscosity-increased portion 404) adjacent to the meniscus of ink in the nozzle 104. At this time, the viscosity-increased portion 404 of ink is in a relatively hard and shallow (thin) state. Thus, by ejecting one or a few large droplets for dummy ejection by line flushing operation, the viscosity of ink in the nozzle or at the meniscus can be returned to its initial value (initial state).

Figure 11B:
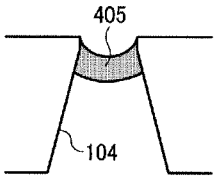
FIG. 11B is a schematic view of another state of the nozzle part during line flushing operation.

By contrast, FIG. 11B shows a state of a nozzle 104 after line flushing operation is performed at a high voltage of micro vibrating pulse. In this case, the high voltage of micro vibrating pulse causes large vibration of the meniscus of ink in the nozzle 104, and a viscosity-increased portion 405 of the surface of ink is pulled inward of the nozzle. As a result, the viscosity-increased portion 405 of ink spreads more inward of the nozzle 104. At this time, the viscosity-increased portion 405 is in a relatively soft and deep (thick) state. Thus, it is preferable to eject a large number of droplets for dummy ejection by line flushing operation to return the viscosity of ink in the nozzle or at the meniscus to its initial value.

As a result, as illustrated in FIG. 9, as the voltage value of micro vibrating pulse increases, the number of defective ejection nozzles is likely to increase.

Figure 12A:
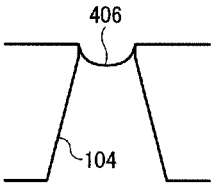
FIG. 12A is a schematic view of a state of a nozzle part during star flushing operation.

By contrast, FIG. 12A shows a state of a nozzle 104 after star flushing operation is performed at a low voltage of micro vibrating pulse. In this case, the low voltage of micro vibrating pulse causes small vibration of the meniscus of ink in the nozzle 104. As a result, the viscosity of ink increases only at a portion (viscosity-increased portion 406) adjacent to the meniscus of ink in the nozzle 104. Since the interval of droplet ejection in star flushing operation is shorter than in line flushing operation, the viscosity increase level of the viscosity-increased portion 406 is relatively small. However, since dummy ejection is performed with less-visible liquid droplets (relatively small liquid droplets), it may be difficult to remove the viscosity-increased portion 406 by a small number of small liquid droplets, thus requiring a large number of liquid droplets.

Figure 12B:
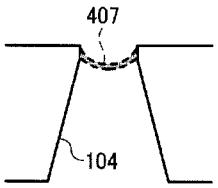
FIG. 12B is a schematic view of another state of the nozzle part during star flushing operation.

By contrast, FIG. 12B shows a state of the nozzle 104 after star flushing operation is performed at a high voltage of micro vibrating pulse. In this case, the high voltage of micro vibrating pulse causes large vibration of the meniscus of ink in the nozzle 104. As a result, a viscosity-increased portion 407 spreads more inward of the nozzle 104 than the viscosity-increased portion 406 illustrated in FIG. 12A. However, since the interval of droplet ejection in star flushing operation is shorter than in line flushing operation, the viscosity increase level of the viscosity-increased portion 407 is relatively small. Thus, the viscosity-increased portion 407 can be removed by ejecting small droplets for dummy ejection.

As a result, as illustrated in FIG. 10, as the voltage value of micro vibrating pulse decreases, the number of defective ejection nozzles is likely to increase.

In consideration of the above-described relation, a first exemplary embodiment of this disclosure is described with reference to FIGS. 13 to 15.

Figures 13, 14:
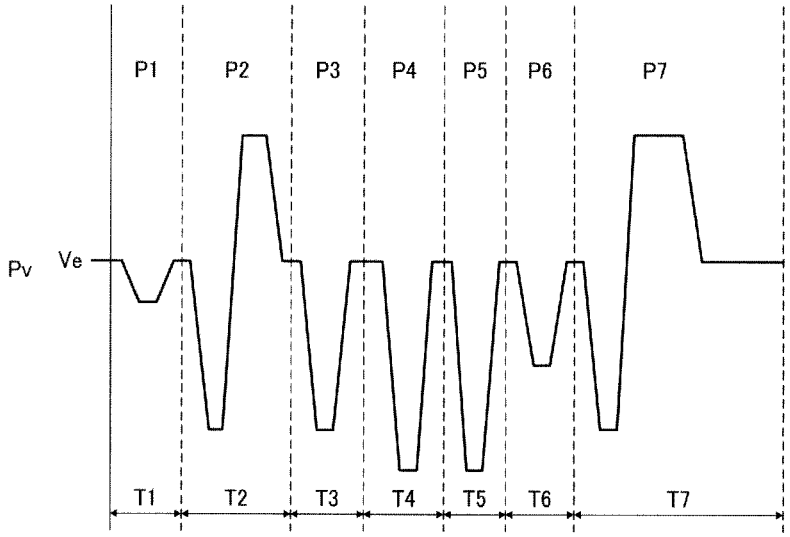
FIG. 13 is a diagram of a driving waveform in a first exemplary embodiment of the present disclosure.
FIG. 14 is a table of selection periods of driving pulses of the driving waveform in the first exemplary embodiment.

FIG. 13 shows a driving waveform in the first exemplary embodiment. FIG. 14 is a table of selection periods of driving pulses of the driving waveform (in the table, circles represent time periods in which the respective driving pulses are selected). FIG. 15 shows ejection pulses and non-ejection pulses created by selecting one or more of the driving pulses of the driving waveform.

The term "driving pulse" used herein represents a pulse serving as an element of a driving waveform. The term "ejection pulse" used herein represents a pulse applied to a pressure generator to eject a liquid droplet. The term "non-ejection pulse" or "micro vibrating pulse" used herein represents a pulse applied to a pressure generator to vibrate (flow) ink in a nozzle without ejecting a liquid droplet.

For example, as illustrated in FIG. 13, a driving waveform Pv includes driving pulses P1 to P7 time-serially created and output.

Figure 15:
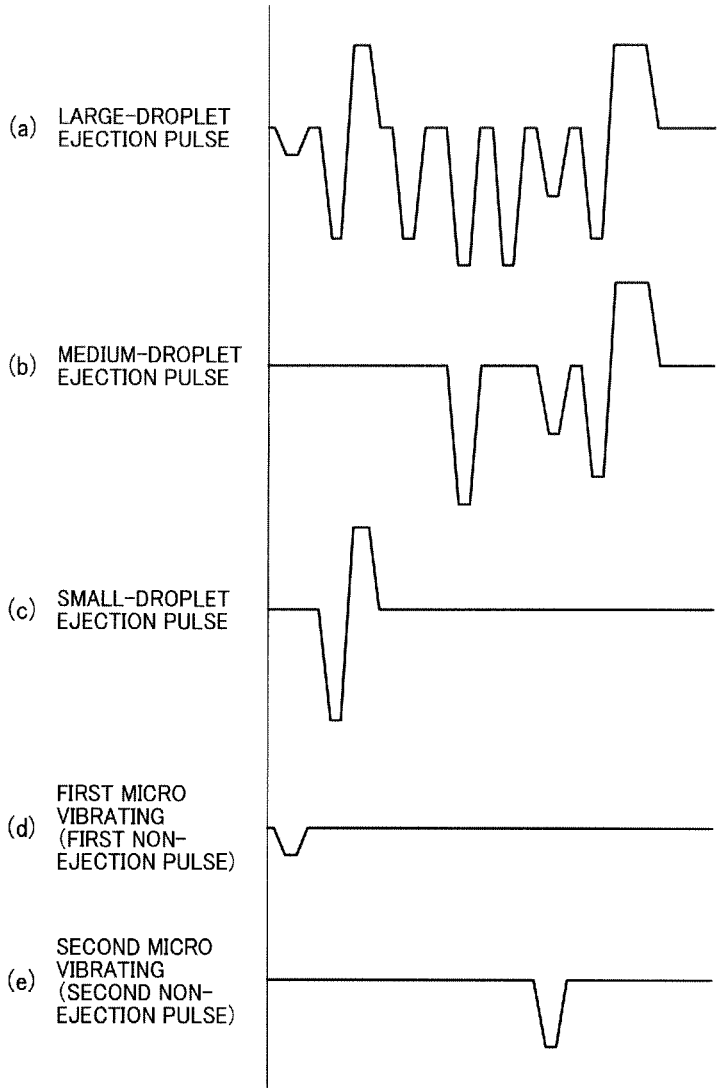
FIG. 15 is a chart of ejection pulses and non-ejection pulses created by selecting one or more of the driving pulses of the driving waveform in the first exemplary embodiment.

As illustrated in FIG. 14, when a large droplet is ejected using droplet control signals M0 to M4, all of the driving pulses P1 to P7 are selected to create an ejection pulse for large droplet (large-droplet ejection pulse) illustrated in (a) of FIG. 15.

In ejecting a medium droplet, the driving pulses P4, P6, and P7 are selected to create an ejection pulse for medium droplet (medium-droplet ejection pulse) illustrated in (b) of FIG. 15.

In ejecting a small droplet, the driving pulse P2 is selected to create an ejection pulse for small droplet (small-droplet ejection pulse) illustrated in (c) of FIG. 15.

In applying a first non-ejection pulse (first micro vibrating pulse), the driving pulse P1 is selected to create the first non-ejection pulse (first micro vibrating pulse) illustrated in (d) of FIG. 15.

In applying a second non-ejection pulse (second micro vibrating pulse), the driving pulse P6 is selected to create the second non-ejection pulse (second micro vibrating pulse) illustrated in (e) of FIG. 15.

Here, since the peak value of the voltage of the driving pulse P6 is set to be greater than that of the driving pulse P1, the amplitude of vibration of the meniscus of ink in the nozzle on application of the second non-ejection pulse is greater than that on application of the first non-ejection pulse.

The large-droplet ejection pulse is used to perform the first dummy ejection (line flushing operation). The small-droplet ejection pulse is used to perform the second dummy ejection (star flushing operation). The ejection pulses for dummy ejection may also be used as printing ejection pulses, thus allowing efficient ejection of liquid droplets.

In addition, when the first dummy ejection (line flushing operation) is performed as dummy ejection operation, micro vibrating is performed by the first micro vibrating pulse (driving pulse P1) to finely vibrate the meniscus of ink at a low micro vibrating voltage (low voltage peak value).

By contrast, when the second dummy ejection (star flushing operation) is performed as dummy ejection operation, micro vibrating is performed by the second micro vibrating pulse (driving pulse P6) to largely vibrate the meniscus of ink at a higher micro vibrating voltage (low voltage peak value) than the driving pulse P1.

Thus, even when any of the line flushing operation and the star flushing operation is performed using the same common driving waveform, the amount of waste liquid consumed by dummy ejection operation can be minimized.

Next, a second exemplary embodiment of this disclosure is described with reference to FIGS. 16 to 18.

Figures 16, 17:
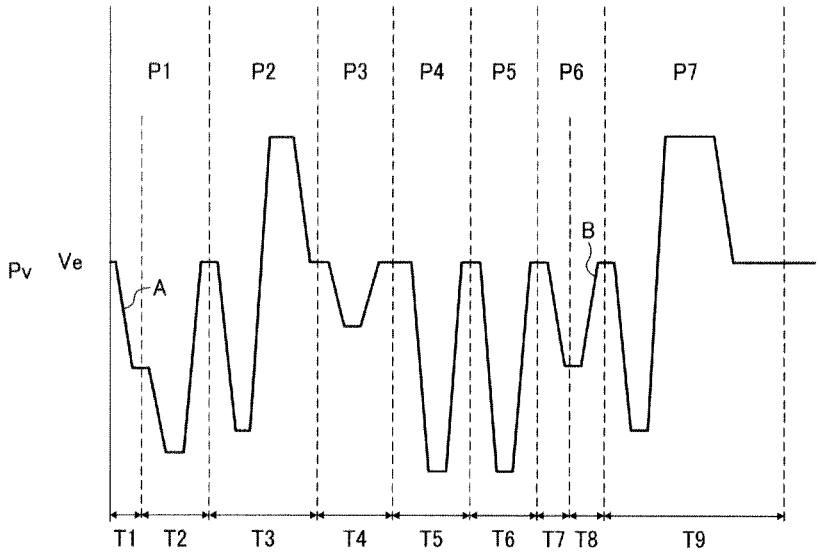
FIG. 16 is a diagram of a driving waveform in a second exemplary embodiment of the present disclosure.
FIG. 17 is a table of selection periods of driving pulses of the driving waveform in the second exemplary embodiment.

FIG. 16 shows a driving waveform in the second exemplary embodiment. FIG. 17 is a table of selection targets from driving pulses of the driving waveform (in the table, circles represent time periods in which the respective driving pulses are selected). FIG. 18 shows ejection pulses and non-ejection pulses created by selecting one or more of the driving pulses of the driving waveform.

For example, as illustrated in FIG. 16, a driving waveform Pv includes driving pulses P1 to P7 time-serially created and output.

Figure 18:
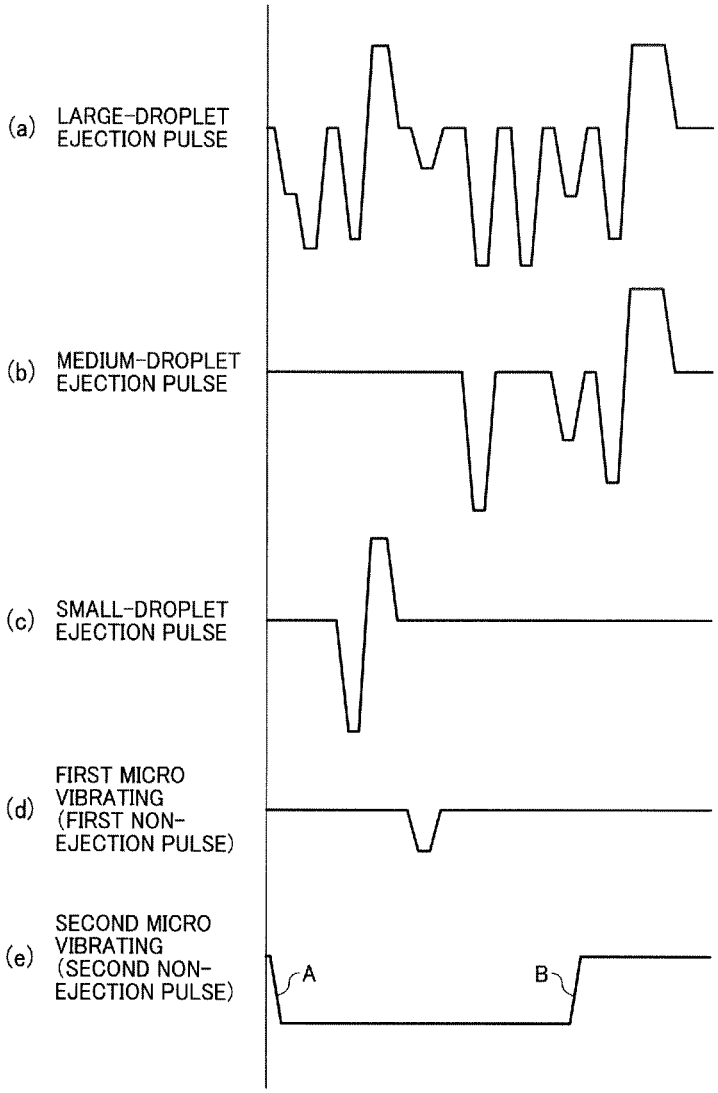
FIG. 18 is a chart of ejection pulses and non-ejection pulses created by selecting one or more of the driving pulses of the driving waveform in the second exemplary embodiment.

As illustrated in FIG. 17, when a large droplet is ejected using droplet control signals M0 to M4, all of the driving pulses P1 to P7 are selected to create an ejection pulse for large droplet (large-droplet ejection pulse) illustrated in (a) of FIG. 18.

In ejecting a medium droplet, the driving pulses P4 (time period T5), P6 (time periods T7 and T8), and P7 (time period T9) are selected to create an ejection pulse for medium droplet (medium-droplet ejection pulse) illustrated in (b) of FIG. 18.

In ejecting a small droplet, the driving pulse P2 (time period T3) is selected to create an ejection pulse for small droplet (small-droplet ejection pulse) illustrated in (c) of FIG. 18.

In applying a first non-ejection pulse (first micro vibrating pulse), the driving pulse P3 (time period T4) is selected to create the first non-ejection pulse (first micro vibrating pulse) illustrated in (d) of FIG. 18.

In applying a second non-ejection pulse (second micro vibrating pulse), a trailing waveform element A (time period T1) of the driving pulse P1 and a rising waveform element B (time period T8) of the driving pulse P6 are selected to create the second non-ejection pulse (second micro vibrating pulse) illustrated in (e) of FIG. 18.

When the second non-ejection pulse (second micro vibrating pulse) is applied, the meniscus of ink in the nozzle is vibrated by the first trailing waveform element A. On returning to the initial position, the meniscus is vibrated by the rising waveform element B. Thus, the meniscus is vibrated substantially twice. As a result, the amplitude or number of vibration of the meniscus of ink in the nozzle on application of the second non-ejection pulse is greater than that on application of the first non-ejection pulse.

In addition, when the first dummy ejection (line flushing operation) is performed as dummy ejection operation, micro vibrating is performed by the first micro vibrating pulse (driving pulse P3) to vibrate the meniscus of ink once.

By contrast, when the second dummy ejection (star flushing operation) is performed as dummy ejection operation, micro vibrating is performed by the second micro vibrating pulse (driving pulses P1 and P6) to vibrate the meniscus of ink substantially twice.

Thus, even when any of the line flushing operation and the star flushing operation is performed using the same common driving waveform, the amount of waste liquid consumed by dummy ejection operation can be minimized.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

a recording head including a plurality of nozzles to eject liquid droplets, a plurality of individual liquid chambers communicated with the plurality of nozzles, and a plurality of pressure generators to generate pressure to pressurize liquid in the plurality of individual liquid chambers;

a head driving control unit to apply an ejection pulse to a pressure generator of the plurality of pressure generators corresponding to an ejection nozzle of the plurality of nozzles to eject liquid droplets from the recording head and a non ejection pulse to a pressure generator of the plurality of pressure generators corresponding to a non ejection nozzle of the plurality of nozzles to vibrate a meniscus of liquid in the non ejection nozzle without ejecting liquid droplets; and a dummy ejection control unit to control dummy ejection operation to eject liquid droplets not contributing to image formation from the recording head, the dummy ejection control unit capable of controlling, as the dummy ejection operation, first dummy ejection operation to eject the liquid droplets not contributing to image formation to a continuous recording medium per a constant length of the continuous recording medium and second dummy ejection operation to eject the liquid droplets not contributing to image formation to an image formation area of the continuous recording medium, wherein, when the dummy ejection control unit controls the first dummy ejection operation, the head driving control unit applies a first non ejection pulse as the non ejection pulse to the pressure generator corresponding to the non ejection nozzle, when the dummy ejection control unit controls the second dummy ejection operation, the head driving control unit applies a second non ejection pulse as the non ejection pulse to the pressure generator corresponding to the non ejection nozzle, and when the second non ejection pulse is applied to the pressure generator corresponding to the non ejection nozzle, an amplitude or number of vibrations of the meniscus of liquid in the non ejection nozzle is greater than when the first non ejection pulse is applied to the pressure generator corresponding to the non ejection nozzle.

2. The image forming apparatus of claim 1, wherein the ejection pulse applied in the dummy ejection operation is same as an ejection pulse applied in image formation.

3. The image forming apparatus of claim 1, wherein the recording head is capable of ejecting different sizes of liquid droplets, the liquid droplets ejected in the first dummy ejection operation are largest of the different sizes of liquid droplets, and the liquid droplets ejected in the second dummy ejection operation are smallest of the different sizes of liquid droplets.

4. The image forming apparatus of claim 1, wherein the head driving control unit includes a driving waveform generator to generate and output a driving waveform including a plurality of driving pulses time-serially per a driving cycle, and a selective applicator to select, as the ejection pulse or the non ejection pulse, at least one driving pulse from the plurality of driving pulses of the driving waveform and apply the at least one driving pulse to the pressure generator corresponding to the ejection nozzle or the non ejection nozzle, respectively, and the selective applicator selects one of the plurality of driving pulses as the first non ejection pulse, two or more of the plurality of driving pulses as the second non ejection pulse, or waveform elements partially from two or more of the plurality of driving pulses as the second non ejection pulse.

* * * * *